US005159236A

United States Patent [19]

Kawai

[11] Patent Number: 5,159,236

[45] Date of Patent: Oct. 27, 1992

[54] INDIRECTLY HEATED CATHODE FOR A GAS DISCHARGE TUBE

[75] Inventor: Koji Kawai, Shizuoka, Japan

[73] Assignee: Hamamatsu Photonics K.K., Shizuoka, Japan

[21] Appl. No.: 769,489

[22] Filed: Oct. 1, 1991

Related U.S. Application Data

[63] Continuation of Ser. No. 482,549, Feb. 21, 1990, abandoned.

[30] Foreign Application Priority Data

Feb. 21, 1989 [JP] Japan ..... 1-41001

[51] Int. Cl.[5] ..... H01J 1/24; H01J 17/06; H01J 17/50

[52] U.S. Cl. ..... 313/340; 313/337

[58] Field of Search ..... 313/340, 270, 337

[56] References Cited

U.S. PATENT DOCUMENTS 1,889,087 11/1932 Crowley ..... 313/340
4,379,980 4/1983 Takanashi et al. .
4,441,048 4/1984 Takaoka et al. ..... 313/346 R

FOREIGN PATENT DOCUMENTS 141138 11/1981 Japan ..... 313/340
80436 4/1988 Japan ..... 313/340

OTHER PUBLICATIONS

Patent Abstracts of Japan, Unexamined Applications, E Section, vol. 4, No. 15, Feb. 5, 1980, pp. 85 E 170, No. 54-156-464.

*Primary Examiner*—Palmer C. DeMeo
*Attorney, Agent, or Firm*—Finnegan, Henderson, Farabow, Garrett and Dunner

[57] ABSTRACT

An indirectly heated cathode incorporated in a gas discharge tube with a discharge current of 0.2 to 0.4 A has a cathode surface area in a range of 10 to 30 mm$^2$. A cathode cylinder is made of molybdenum, nickel or alloy thereof. A heater coated with alumina for insulation is inserted into the cylinder in such a manner that the distance between the heater and cylinder is 0.1 mm or less, and coil gaps of the heater are set to 0.15 mm or less. Alternatively, the space between the heater and cylinder is filled with alumina. As a result, the ratio of a heat quantity by forced heating to a heat quantity for starting discharge is made 0.3 or less.

9 Claims, 1 Drawing Sheet

INDIRECTLY HEATED CATHODE FOR A GAS DISCHARGE TUBE

This application is a continuation, division, of application Ser. No. 07/482,549 filed Feb. 21, 1990 now abandoned.

BACKGROUND OF THE INVENTION

This invention relates to an indirectly heated cathode of a gas discharge tube which is used as a light source for various analyses and quantitative measurements.

One example of a gas discharge tube is a deuterium lamp as shown in FIG. 5. The deuterium lamp 1 comprises: a transparent sealed envelope 2; and an anode 3, a cathode 4 and a shield electrode 5 which are provided in the envelope 2. The shield electrode 5 has a small hole 6 serving as an electron converging portion, and a light transmission window 7.

When, in the gas discharge tube thus constructed, the cathode 4 is heated and simultaneously a voltage is applied across the anode 3 and the cathode 4, arc discharge is induced between the anode 3 and the cathode 4 through the small hole 6, thus producing light. Only part of a positive column can pass through the small hole 6, thus producing a spot light which is transmitted through the light transmission window 7.

An indirectly heated cathode for such a deuterium lamp 1 has been disclosed by Japanese Patent Application Examined Publication No. 56628/1987. As shown in FIG. 3, a double coil (coating coil) 9 of a tungsten filament is wound around the outer wall of a heat-resisting and thermally conductive cylinder 8. An electron emitting material layer 10 is formed in such a manner as to contain the double coil 9 by filling the space between the turns of the primary and secondary coils of the double coil 9 with barium carbonate, strontium carbonate or calcium carbonate, or a mixture of them. A coiled heater 11 is inserted into the cylinder 8. The cylinder 8 is conductively connected to the heater 11 through a support 12, and installed in the discharge tube. The discharge tube thus fabricated is evacuated to $10^{-3}$ Torr or less, and current is applied to the heater 11. As a result, the above-described carbonates are thermally decomposed, and the electron emitting material layer 10 of oxides is completed.

A conventional indirectly heated cathode needs a larger quantity of heat when preheated and operated: $W_{pr}=6.37$ W when preheated (where $W_{pr}$ is a quantity of heat required for the cathode to start discharging, or a quantity of heat required for the cylinder surface temperature to reach 700° C.), $W_{ou}=2.4$ W when operated (where $W_{ou}$ is a quantity of heat which the heater applies to the cathode during discharging, being called "forced heating"); that is, $W_{ou}/W_{pr}=0.38$. Thus, the cathode is different in specification from a conventional directly heated cathode as follows:

| | Conventional indirectly heated cathode | Directly heated cathode |
|---|---|---|
| Preheating voltage | 10 V | 10 V |
| Preheating current | 1.1 A | 0.8 A |
| Operating voltage | 7 V | 3.5 V |
| Operating current | 0.8 A | 0.3 A |

As is apparent from the above-described table, the preheating current and the operating voltage of the conventional indirectly heated cathode are larger than those of the directly heated cathode. Therefore, the indirectly heated cathode type gas discharge tube is not interchangeable with the corresponding (10 V) directly heated cathode type gas discharge tube.

SUMMARY OF THE INVENTION

Accordingly, an object of this invention is to miniaturize an indirectly heated cathode, to lengthen its service life and to decrease its preheating current, thereby to provide an indirectly heated cathode type gas tube which is interchangeable with the corresponding directly heated cathode type gas tube.

In a gas discharge tube having a discharge current of 0.2 to 0.4 A, an indirectly heated cathode according to the invention has a cathode surface area (SS) which is in a range of 10 to 30 $mm^2$.

In the indirectly heated cathode, a cylinder is made of molybdenum, nickel or alloy thereof. A heater coated with alumina for insulation is inserted into the cylinder in such a manner that the distance (SD) between the heater and cylinder is 0.1 mm or less, and the coil gaps (CD) of the heater are set to 0.15 mm or less, or the space between the heater and cylinder is filled with alumina, so that the ratio $W_{ou}$(a quantity of heat by forced heating)/$W_{pr}$(a quantity of heat for starting discharge) is 0.3 or less when the discharge current is 0.2 to 0.4 A.

Furthermore, in the indirectly heated cathode, the heater is made of a wire of tungsten or tungsten alloy, and has a wire diameter (d) in a range of 0.05 to 0.18 mm.

Moreover, in the indirectly-heated cathode, with the discharge current in a range of 0.2 to 0.4 A, the surface area (SK) of an electron emitting material layer of the cathode is less than the cathode surface area and in a range of from 1.5 $mm^2$ to 30 $mm^2$.

DETAILED DESCRIPTION OF THE PREFERRED EMBODIMENTS

Preferred embodiments of this invention will be described hereinafter.

Heat sources for operation of the cathode of a gas discharge tube are roughly classified into the following two groups:

(1) Self-heating ($W_{se}$): the heat generated by the impact of ions on a cathode surface by discharging, and Joule heat generated in an intermediately formed layer in the cathode surface which is a high insulation oxide layer formed between an electron emitting material and a base metal during discharging.

(2) Forced heating ($W_{ou}$): the heat applied from a heater to which a power is supplied from an external power source.

One of the important factors for a hot-cathode is that the quantity of heat provided to the cathode surface by the above-described self-heating and forced heating is in thermal balance with the loss of heat caused by thermal conduction and radiation from the cathode surface into the gas in the lamp and by thermal conduction from a support 12. If the quantity of heat provided to the cathode surface is smaller than $W_{op}$, which is a quantity of heat required for stable operation of the hot-cathode, then discharging becomes unstable in location and oscillation occurs, thus resulting in variation of the optical output.

Figure 1:
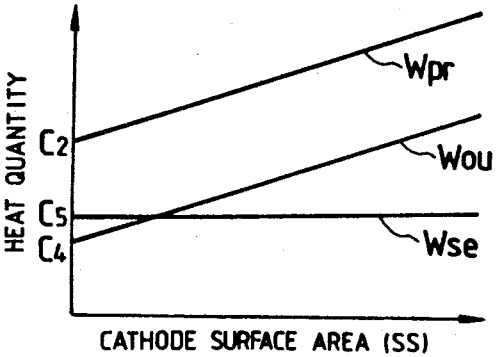
FIGS. 1 and 2 are characteristic diagrams indicating cathode surface areas with quantities of heat.

This is as indicated in FIG. 1, a graphical representation. In FIG. 1, it can be considered that $W_{pr} \propto W_{op}$, or $W_{pr} \approx W_{op}$. The quantities $W_{pr}$ and $W_{ou}$ are generally in proportion to the contact area between the cathode and the gas. If there is a gap (SD) between the cylinder 8 and the alumina-coated heater 11 or if there is a gap (CD) between turns of the heater coil, then thermal convection takes place through those gaps, thus causing thermal loss. However, in the case where the clearance (SD) between the cylinder 8 and the alumina-coated heater 11 is 0.1 mm or less, and the coil gap (CD) is 0.15 mm or less, it may be regarded that the cylinder 8 is substantially in contact with the heater 11. If the cylinder 8 and the heater 11 are provided as one unit in the cathode by impregnation of alumina in a space 14 between the cylinder 8 and the heater 11, it is unnecessary to take the loss of heat through those gaps into account. Therefore, it can be considered in the above cases that the loss of heat is proportional to the cathode surface area (SS). The above-described data are related to one another as indicated below:

$$W_{pr} \propto W_{ou} + W_{se} = W_{op} \ldots \quad (1)$$

$$W_{pr} = C_1 \cdot SS + C_2 \ldots \quad (2)$$

$$W_{ou} = C_3 \cdot SS + C_4 \ldots \quad (3)$$

$$W_{se} = C_5 \ldots \quad (4)$$

$$C_2 > C_4 \ldots \quad (5)$$

where $C_1$ through $C_5$ are constants ($C_2$ and $C_4$are heat quantities of loss by thermal conduction etc. from the support 12).

From expressions (2) and (3), $$\frac{W_{ou}}{W_{pr}} = \frac{C_3 \cdot SS + C_4}{C_1 \cdot SS + C_2} \quad (6)$$

Figure 2:
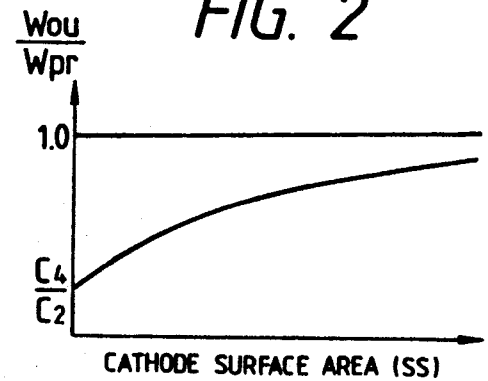

This relation is as indicated in FIG. 2, a graphical representation. That is, as SS decreases, $W_{pr}$ is decreased and $W_{ou}$ becomes relatively small with respect to $W_{pr}$. This means that a cathode operating with relatively little energy can be obtained.

For confirmation of this fact, the following results were obtained through experiments:

| SS ($mm^2$) | Minimum $W_{pr}$ (W) | Minimum $W_{ou}$ (W) | $W_{ou}/W_{pr}$ |
|---|---|---|---|
| 21.9 | 3.50 | 0.9 | 0.26 |
| 24.6 | 4.16 | 1.2 | 0.29 |
| 30.6 | 4.80 | 1.5 | 0.31 |
| 53.1 | 6.37 | 2.4 | 0.38 |

The experiments were carried out with a discharge current $I_p$ of 0.3 A and a molybdenum support 0.15 mm in diameter.

The data $W_{ou}$ was recorded with test lamps which had 1500 hours of service life. The term "lamp's service life" as used herein is intended to mean a period in which the optical output variation is kept less than $0.05\%_{p\text{-}p}$. Thus, the relation $W_{ou}/W_{pr} < 0.3$ has been obtained with $I_p = 0.3$ A.

However, it is necessary that the surface area (SK) of the electron emitting material layer 10 is 1.5 $mm^2$ or more. It has been confirmed that, if SK is less than 1.5 $mm^2$, the cathode's discharge current density causes problems. That is, sputtering of the cathode material occurs, resulting in reduction of the service life of the cathode.

The heater 11 should be composed of tungsten or its alloy, and the heater wire diameter (d) should be in a range of $0.04 < d < 0.18$ mm. If $d < 0.04$ mm, it is necessary to increase the heater temperature to an excessively high value in order to obtain the predetermined quantity of heat. In this case, the alumina layer (having a melting point of about 1700° C.) coated on the heater 11 for insulation from the cylinder 8 would be evaporated. On the other hand, if $d > 0.18$ mm, the heater 11 would unavoidably become bulky when coiled, and would be difficult to insert into the cylinder 8.

Figure 5:
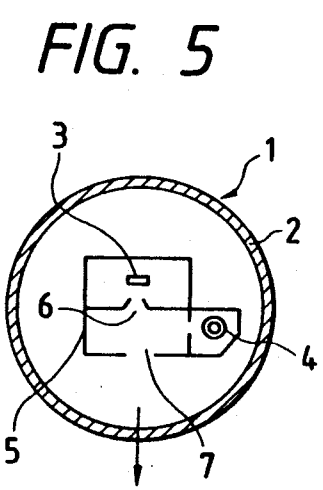
FIG. 5 is a cross sectional diagram showing a gas discharge tube.
Figure 4:
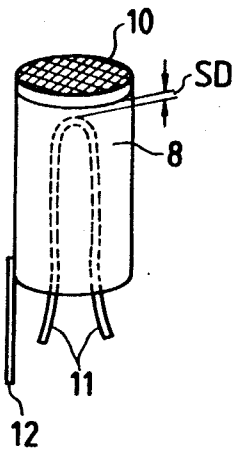
FIG. 4 is a perspective view showing an indirectly heated cathode of end discharge type.
Figure 3:
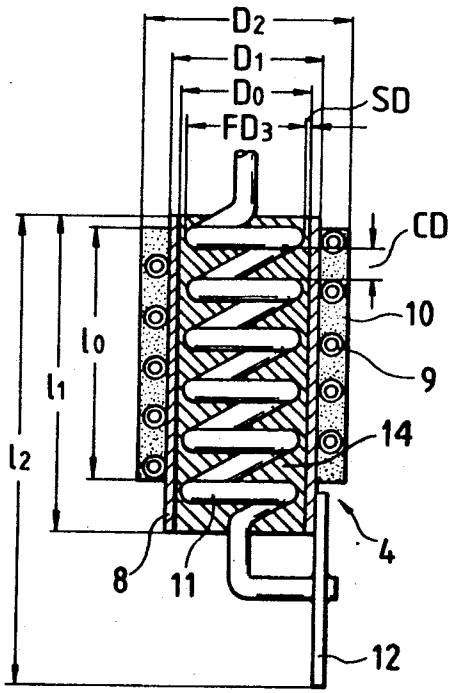
FIG. 3 is a sectional diagram showing an indirectly heated cathode of side discharge type.

In the invention, the cathode 4 may be formed as shown in FIGS. 3 or 4. In the case of FIG. 3, the side of the cylinder 8 is used for discharging. In the case of FIG. 4, the top of the cylinder 8 is used for discharging. In FIG. 3, reference character SD designates the distance between the heater 11 and the inside of the side wall the cylinder 8; and in FIG. 4, it designates the distance between the heater 11 and the inside of the top of the cylinder 8.

The terms used in the above description are defined as follows:

Cathode surface area (SS):

$$SS = \pi\{D_2 \times l_0 + D_1 \times (l_1 - l_0)\}$$

Electron emitting material layer's surface area (SK):

$$SK = \pi D_2 \times l_0$$

where $D_1$ is the outside diameter, $D_0$ is the inside diameter, $l_1$ is the length of the cylinder 8, and $l_0$ is the length of the electron emitting material layer 10.

Coating coil 9

A coil of tungsten or its alloy which is wound around the outer wall of the cylinder 8, to hold the electron emitting material 10.

Support 12

A supporting rod allowing discharge current to flow between the cathode 4 and the lamp electrode pin.

Cathode 4

A structure comprising the cylinder 8, coating coil 9, support 12 and electron emitting material layer 10.

Heater 11

A double coil or single coil inserted into the cylinder 8, serving as a heat source.

Intermediately formed layer

An oxide layer formed between an electron emitting material 10 (Ba, Ca, Sr)O and a base metal W or Ni, mainly during discharging, exhibiting high insulation.

$W_{pr}$

A qualtity of heat requried for the cathode 4 to start discharging.

$W_{op}$

A quantity of heat required for the cathode 4 to stably operate during discharging, being substantially equal to $W_{pr}$.

$W_{ou}$

A quantity of heat applied to the cathode 4 by the heater 11 during discharging, the heating being called "forced heating".

$W_{se}$

A quantity of heat generated in the cathode 4 during discharging by the impact of ions and by the Joule heat produced by the discharge current in the intermediately formed layer. This heating is called "self-heating". The quantity of heat is constant unless the discharge current changes.

Distance (SD) between the cylinder 8 and the heater 11:

$$SD=(D_0-FD_3)/2$$

where $FD_3$ is the outside diameter of the coiled heater 11.

Coil gap (CD) of the heater 11

A gap in the longitudinal direction between adjacent turns of the heater winding.

In the above-described embodiments, the discharge current $I_p$ is 0.3 A. However, the discharge current may be in a range of 0.2 to 0.4 A.

The indirectly heated cathode according to the invention constructed as described above has specifications substantially equal to those of the conventional directly heated cathode, and, in addition, superior characteristics as compared to the directly heated cathode. Furthermore, the energy consumed by the indirectly heated cathode of the invention is less than 70% of that consumed by the conventional directly heated cathode when it is preheated, and less than 25% when operated.

There is available a deuterium gas discharge tube having a directly heated cathode of 10 V and 0.8 A (8 W) in preheating and 3.5 V and 0.35 A (1.2W) in operation. However, its service life is not more than 500 hours. On the other hand, the indirectly heated cathode according to the invention is of 10 V and 0.65 A (6.5 W being about 80% of that of the conventional directly heated cathode) in preheating and 3.5 V and 0.3 A (1.05 W being about 85% of that of the conventional directly heated cathode) in operation, and has a service life of more than 1000 hours.

What is claimed is:

1. An indirectly heated cathode in a gas discharge tube having a discharge current of 0.2 to 0.4 A, comprising a metallic cylinder having a cathode surface area comprising the outside surface area of said cylinder having a range of 10 to 30 $mm^2$ and means for heating the metallic cylinder, wherein the cathode surface area is in a range of 10 to 30 $mm^2$.

2. An indirectly heated cathode as claimed in claim 1, wherein said means for heating comprises a heater made of a wire of tungsten or tungsten alloy, said heater having a wire diameter in a range of 0.05 to 0.18 mm.

3. An indirectly heated cathode in a gas discharge tube having a discharge current of 0.2 to 0.4 A, comprising:

a cylinder made of molybdenum, nickel or alloy thereof; and a coiled heater coated with alumina for insulation and inserted into said cylinder in such a manner that a distance between said heater and said cylinder is 0.1 mm or less;

a coil gap of said heater being set to 0.15 mm or less; wherein a ratio of a quantity of heat by forced heating to a quantity of heat for starting discharge is 0.3 or less when said discharge current is 0.2 to 0.4 A.

4. An indirectly heated cathode as claimed in claim 3, wherein sad indirectly heated cathode has a cathode surface area in a range of 10 to 30 $mm^2$.

5. An indirectly heated cathode in a gas discharge tube having a discharge current of 0.2 to 0.4 A, comprising:

a cylinder made of molybdenum, nickel or alloy thereof; and a heater inserted into said cylinder in such a manner that a space between said heater and said cylinder is filled with alumina; wherein a ratio of a quantity of heat by force heating to a quantity of heat for starting discharge is 0.3 or less when said discharge current is 0.2 to 0.4 A.

6. An indirectly heated cathode as claimed in claim 5, wherein said indirectly heated cathode has a cathode surface area in a range of 10 to 30 $mm^2$.

7. An indirectly heated cathode as claimed in any one of claims 3 and 5, wherein said heater is made of a wire of tungsten or tungsten alloy, and has a wire diameter in a range of 0.05 to 0.18 mm.

8. An indirectly heated cathode as claimed in claim 7, wherein said indirectly heated cathode has a cathode surface area in a range of 10 to 30 $mm^2$.

9. An indirectly heated cathode as claimed in any one of claims 1, 2, 3, 4 and 6 further comprising an electron emitting material layer having a surface area and partially covering said cylinder, the surface area of said electron emitting material layer being less than the cathode surface area and in a range of from at least 1.5 $mm^2$ to less than 30 $mm^2$.

* * * * *

UNITED STATES PATENT AND TRADEMARK OFFICE

CERTIFICATE OF CORRECTION

PATENT NO. : 5,159,236

DATED : October 27, 1992

INVENTOR(S) : Koji Kawai

It is certified that error appears in the above-identified patent and that said Letters Patent is hereby corrected as shown below:

Claim 4, column 6, line 22, change "sad" to --said--.

Claim 5, column 6, line 32, change "force" to --forced--.

Signed and Sealed this

Fourth Day of January, 1994

Bruce Lehman

*Attest:*

BRUCE LEHMAN

*Attesting Officer*

*Commissioner of Patents and Trademarks*